US006924765B2

(12) United States Patent
Ro et al.

(10) Patent No.: US 6,924,765 B2
(45) Date of Patent: Aug. 2, 2005

(54) MICROSTRIP PATCH ARRAY ANTENNA FOR SUPPRESSING SIDE LOBES

(75) Inventors: Haeng Sook Ro, Seoul (KR); Soon Ik Jeon, Daejon (KR); Jong Suk Chae, Daejon (KR)

(73) Assignee: Electronics and Telecommunications Research Institute (KR)

( * ) Notice: Subject to any disclaimer, the term of this patent is extended or adjusted under 35 U.S.C. 154(b) by 4 days.

(21) Appl. No.: 10/618,542

(22) Filed: Jul. 11, 2003

(65) Prior Publication Data

US 2004/0051667 A1 Mar. 18, 2004

(30) Foreign Application Priority Data

Sep. 18, 2002 (KR) ..... 10-2002-0056940

(51) Int. Cl.[7] ..... H01Q 1/38
(52) U.S. Cl. ..... 343/700 MS
(58) Field of Search ..... 343/700 MS, 844, 343/851, 852, 824

(56) References Cited

U.S. PATENT DOCUMENTS

| | | | | | |
|---|---|---|---|---|---|
| 4,414,550 | A | * | 11/1983 | Tresselt | 343/700 MS |
| 4,912,479 | A | * | 3/1990 | Nishimura et al. | 342/408 |
| 4,937,585 | A | * | 6/1990 | Shoemaker | 343/700 MS |
| 6,529,174 | B2 | * | 3/2003 | Stjernman | 343/909 |
| 6,583,760 | B2 | * | 6/2003 | Martek et al. | 342/373 |
| 6,621,470 | B1 | * | 9/2003 | Boeringer et al. | 343/853 |

FOREIGN PATENT DOCUMENTS

| | | |
|---|---|---|
| JP | 11-088044 | 3/1999 |
| JP | 2000-228606 | 8/2000 |
| JP | 2000-236213 | 8/2000 |
| KR | 2001-108546 | 12/2001 |

OTHER PUBLICATIONS

Eugene D. Sharp; "A Triangular Arrangement of Planar–Array Elements That Reduces the Number Needed", IRE Transactions on Antennas and Propagation, vol. AP–9, No. 2, Mar. 1961, pp. 126–129.

Korea Communication Papers in Summer, Jul. 5, 2001; "The Study of an Optimization Phased Array Antennas" (Abstract).

Microwaves and Radio waves Paper in Spring, vol. 23, No. 1, May. 20, 2000, pp. 313–317; "Analysis of the Cavity–Backed Circular Microstrip Array Antenna With Triangular Grid" (Abstract).

* cited by examiner

*Primary Examiner*—Shih-Chao Chen
*Assistant Examiner*—Minh Dieu A
(74) *Attorney, Agent, or Firm*—Blakely Sokoloff Taylor & Zafman

(57) ABSTRACT

A microstrip patch array antenna suppressing side lobes. The microstrip patch array antenna have a plurality of antenna array elements on two-dimensional planar having A axis and B axis for suppressing side lobes, wherein the antenna array elements are linearly arranged in a direction of the A axis by spacing a first predetermined distance between the antenna array elements, the arranged array elements are arranged in a direction of the B axis by spacing a second predetermined distance between the antenna array elements and a predetermined portion of the microstrip patch array antenna having the arranged array elements are horizontally shifted to a predetermined distance. The present invention can reduce leakage of signal or prevent to receive undesired signal and to transmit signals to undesired direction by using the above mentioned array pattern instead of reducing a distance of spacing between antenna elements.

6 Claims, 7 Drawing Sheets

MICROSTRIP PATCH ARRAY ANTENNA FOR SUPPRESSING SIDE LOBES

FIELD OF THE INVENTION

The present invention relates to a microstrip patch array antenna; and, more particularly, to a microstrip patch array antenna having an array pattern for decreasing a grating lobe in order to suppress side lobes in an electric active phase array antenna.

DESCRIPTION OF RELATED ARTS

An active phase array antenna using a microstrip patch array antenna has been widely used in a satellite communication. However, the active phase array antenna degrades a characteristic of side lobes according to beam scan angle or antenna array grid pattern designs. Specially, generation of grating lobe causes to receive an undesired signal or to transmit a signal to an undesired direction. Also, the signal could be leakage.

Besides, in case the active phase array antenna using the microstrip patch array antenna is used as a portable mobile satellite antenna, it is very hard to satisfy the strict standard of the antenna radiation pattern for side lobes. Therefore, for overcoming the above mentioned problems, new grid array pattern has been demanded.

In case of conventional array antenna, a rectangular grid pattern is generally used. Spaces between array elements for suppressing the grating lobe need to satisfy conditions in below equation in case the array antenna having the rectangular grid pattern.

$$\frac{D_a \text{ (or } D_b)}{\lambda} p \frac{1}{1+|\sin\theta_0|}, \qquad \text{Eq. 1}$$

wherein $D_a$ and $D_b$ are the spacing between array elements and $\theta_0$ is the maximum electric beam scan angle.

However, it is very difficult to have the spacing between array elements satisfying Eq. 1 since complexity of hardware structure having a plurality of feed networks and a number of array elements in view of manufacturing the array antenna.

Therefore, it has been demanded that a new method suppresses the side lobes without satisfying condition of Eq. 1 by controlling the spacing between array elements.

Meanwhile, a triangle grid pattern has been introduced for overcoming the above mentioned problem. The triangle grid pattern can decrease the side lobes without shortening the spacing between array elements comparing to the rectangular grid pattern.

Although above-mentioned, the conventional triangle grid pattern still has a problem of complexity in manufacturing, which is caused by non-continuation structure between array elements of triangular grid pattern.

SUMMARY OF THE INVENTION

It is, therefore, an object of the present invention to provide a microstrip patch array antenna for suppressing side lobes, wherein the microstrip patch array antenna having a plurality of antenna elements, which are arranged on two dimensional rectangular planar having two axis A and B and the arranged antenna elements are divided in direction of axis B and one of divided arranged antenna elements are shifted to a direction of axis A within a predetermined spacing.

In accordance with an aspect of the present invention, there is provided a microstrip patch array antenna having a plurality of antenna array elements on two-dimensional planar having A axis and B axis for suppressing side lobes, wherein the antenna array elements are linearly arranged in a direction of the A axis by spacing a first predetermined distance between the antenna array elements, the arranged array elements are arranged in a direction of the B axis by spacing a second predetermined distance between the antenna array elements and a predetermined portion of the microstrip patch array antenna having the arranged array elements are shifted to the direction of A axis within a predetermined distance.

BRIEF DESCRIPTION OF THE DRAWING(S)

The above and other objects and features of the present invention will become apparent from the following description of the preferred embodiments given in conjunction with the accompanying drawings, in which.

DETAILED DESCRIPTION OF THE INVENTION

Other objects and aspects of the invention will become apparent from the following description of the embodiments with reference to the accompanying drawings, which is set forth hereinafter.

Hereinafter, the present invention is explained in detail by comparing the present invention to a conventional antenna array grid pattern as referring to FIGS. 1 and 2.

Figure 1:
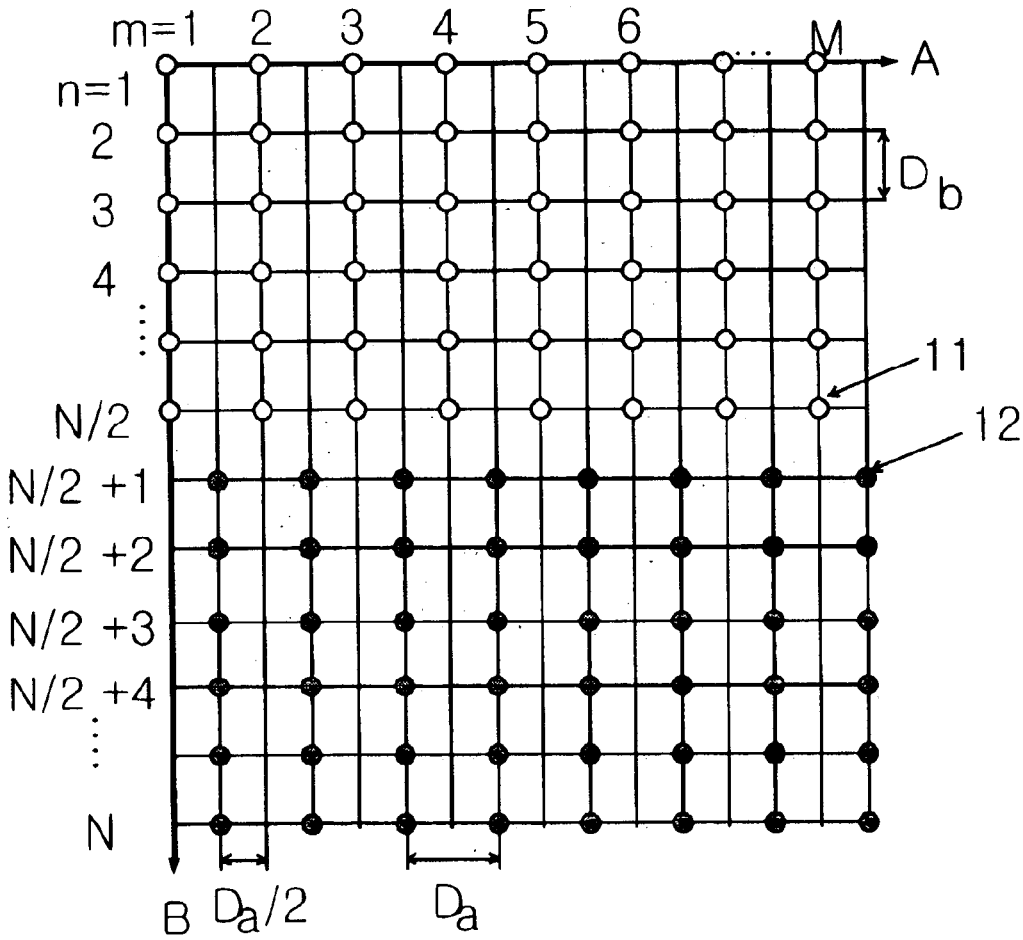
FIG. 1 is a diagram for illustrating a microstrip patch array antenna having an array pattern for suppressing a side lob in accordance with a preferred embodiment of the present invention.
Figure 2:
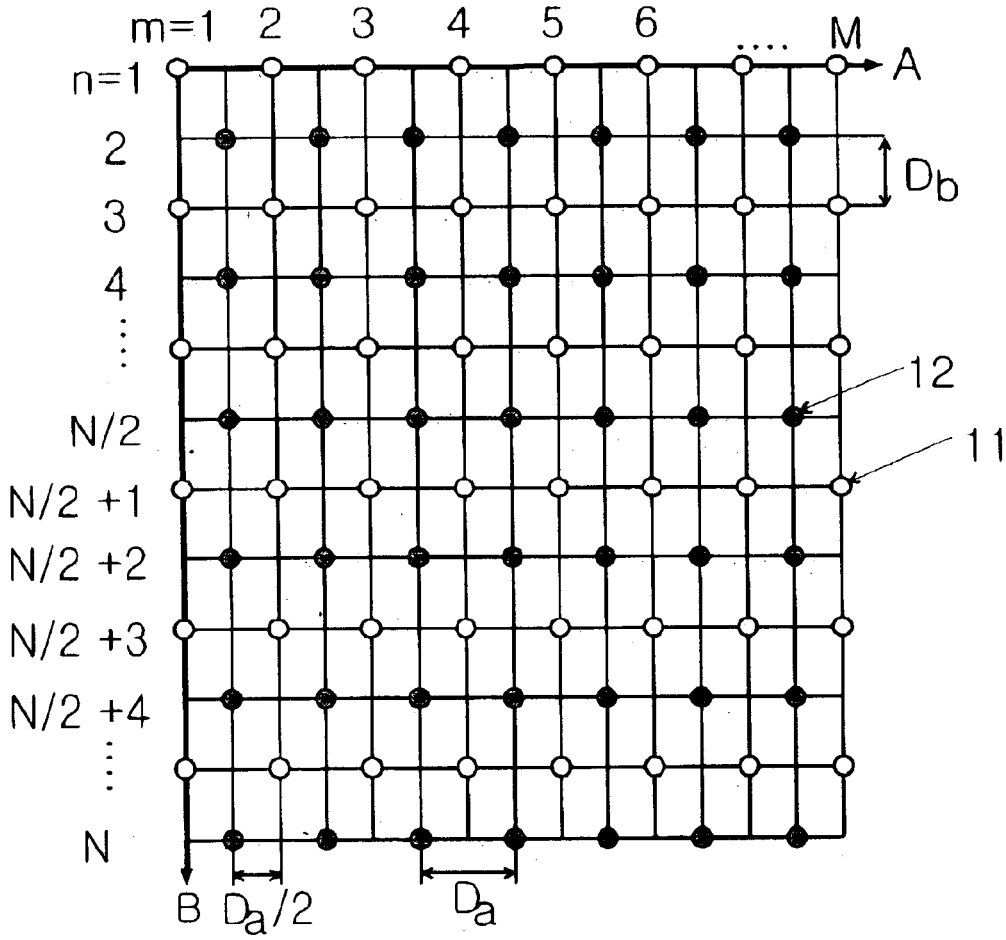
FIG. 2 is a diagram for showing a conventional array antenna having a triangle grid pattern.

At first, array elements 11 and 12 in FIGS. 1 and 2 are compared for explaining the present invention.

FIG. 1 is a diagram for illustrating a microstrip patch array antenna having an array pattern for suppressing a side lob in accordance with a preferred embodiment of the present invention.

Referring to FIG. 1, when M integer number of antenna array elements are arranged within a spacing $D_a$ in a direction of A axis and N integer number of array elements are arranged within a spacing $D_b$ in a direction of B axis, 1 to $(N/2)^{th}$ array elements in a direction of B axis are arranged a conventional rectangular array grid and $(N/2)+1$ to $N^{th}$ array elements are arranged by shifting 1 to N/2 array elements to the direction of A axis as much as $D_a/2$ and to the direction of B axis as much as $D_b \times N/2$.

FIG. 2 is a diagram for showing a conventional array antenna having a triangle grid pattern.

In the conventional array antenna having the triangle array grid, when M integer number of the antenna array elements are arranged to a direction A and N integer number of the arrays elements are arranged to a direction B, array elements of 1, 3, 5, . . . , $(N-1)^{th}$ are arranged in the direction B first and then array elements of 2, 4, 6, . . . , $N^{th}$ are arranged by shifting them as much as $D_a/2$ to the direction A and as much as $D_b$ to the direction B.

Figure 3:
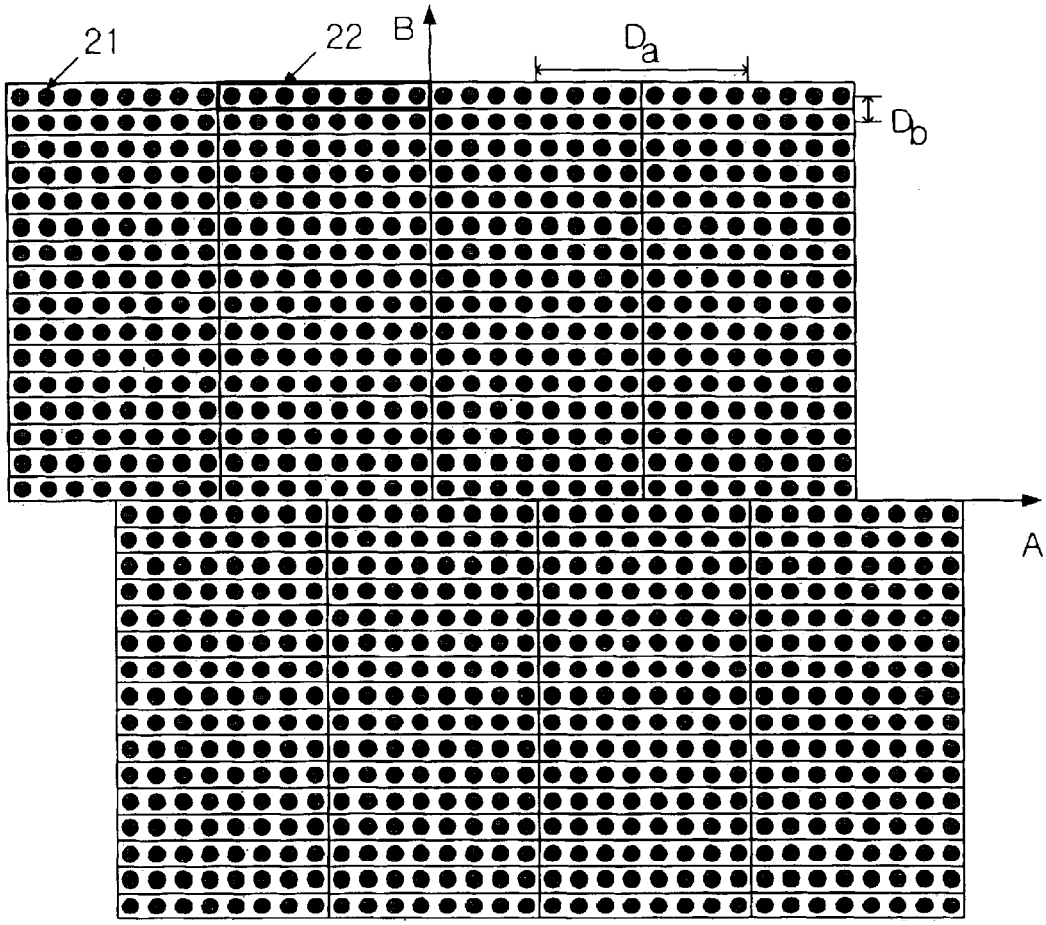
FIG. 3 is a diagram for illustrating a microstrip patch array antenna composed of sub arrays in accordance with a preferred embodiment of the present invention.

FIG. 3 is a diagram for illustrating a microstrip patch array antenna composed of sub arrays in accordance with a preferred embodiment of the present invention. That is, the antenna array grid pattern of the present invention has a plurality of 8×1 unit sub arrays.

Inhere, the unit sub array element 22 is a form arranging a unit radiation element 21 as 8×1. Referring to FIG. 3, a spacing of unit sub elements 22 in A direction is $D_a$ and the spacing of unit sub elements 22 in B direction is $D_b$.

As shown in FIG. 3, the microstrip patch array antenna is divided by half based on a direction of B and one part of divided microstrip patch array antenna is shifted in A direction as much as $D_a/2$.

Figure 4A:
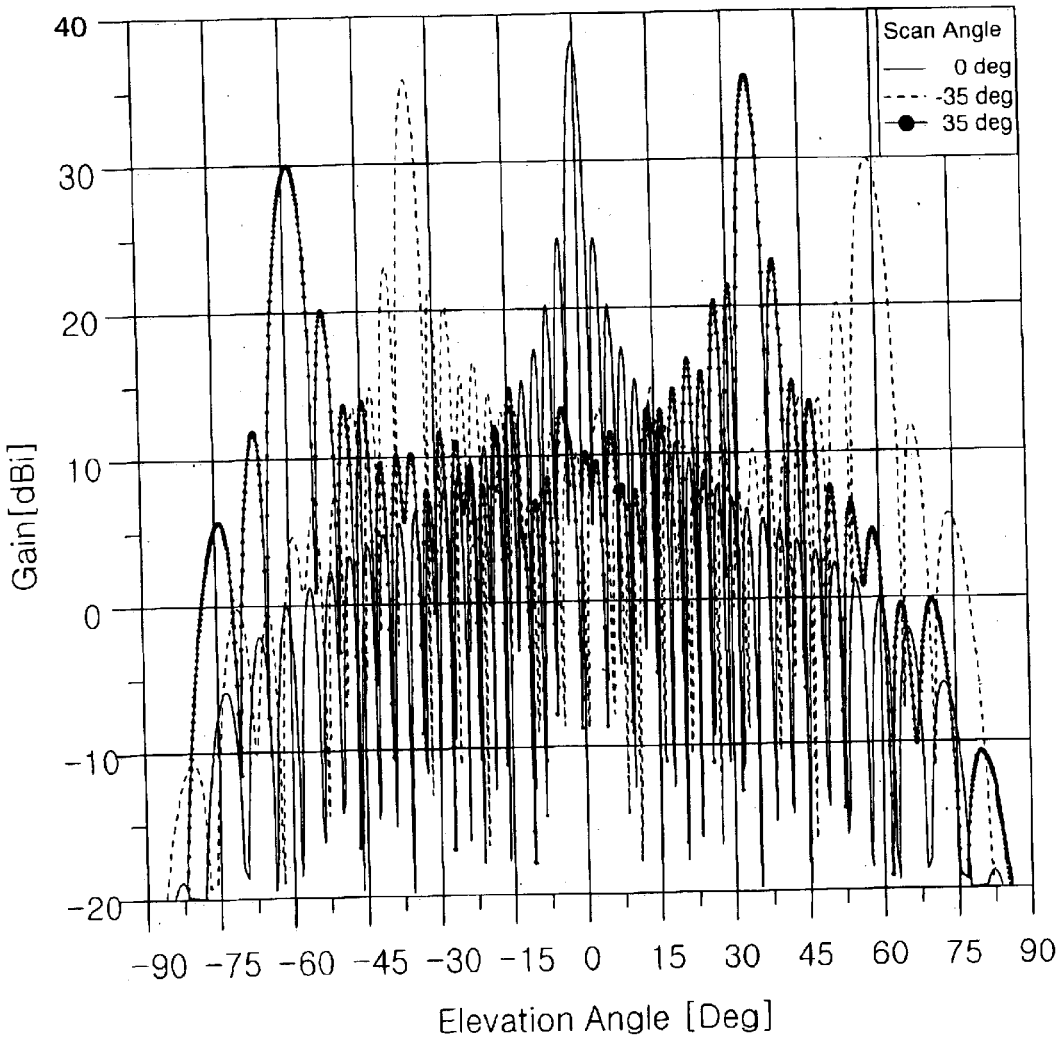
FIGS. 4A and 4B are graphs showing radiation pattern of a microstrip patch array antenna having an array pattern for suppressing side lobes in accordance with a preferred embodiment of the present invention.
Figure 4B:
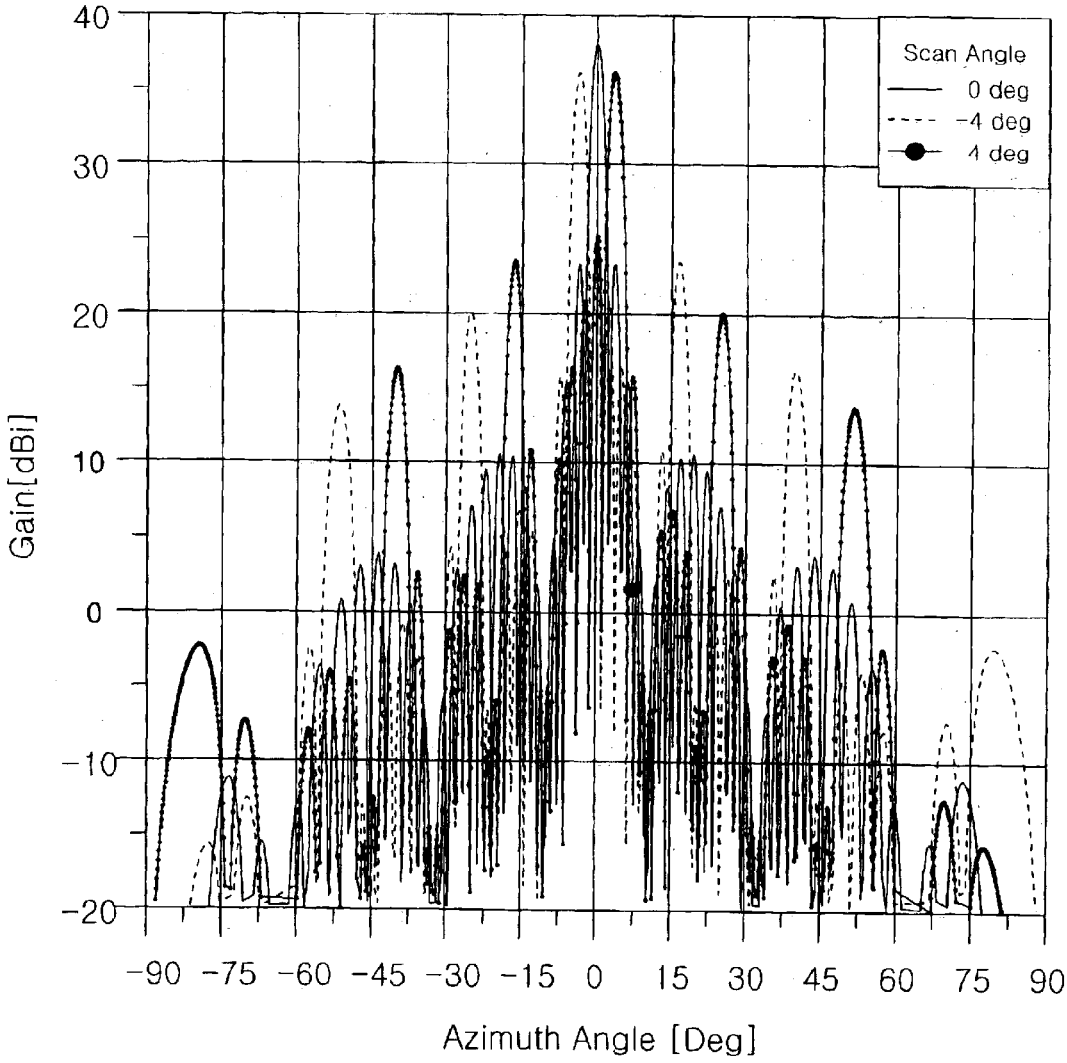
Figure 5A:
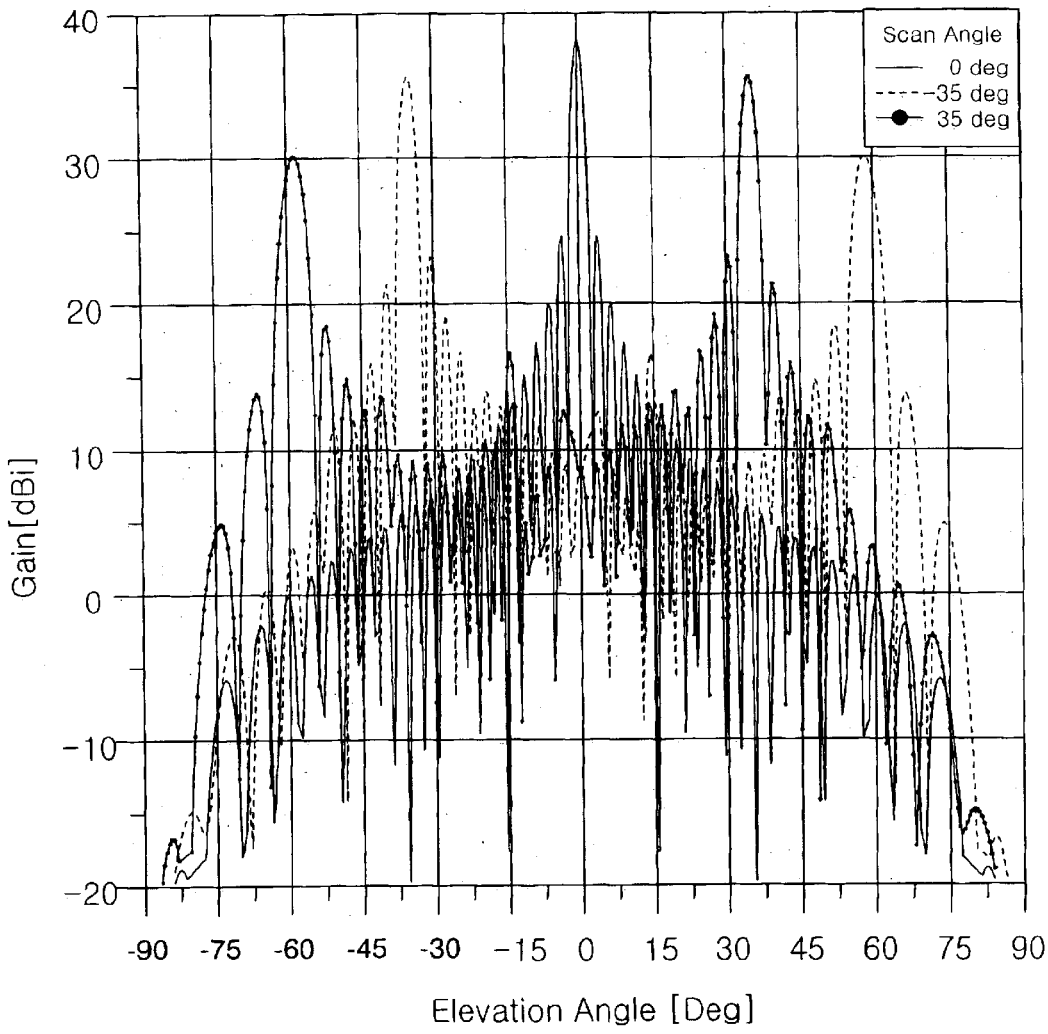
FIG. 5A (PRIOR ART)
FIGS. 5A and 5B are graphs for showing conventional radiation pattern of conventional microstrip path array antenna having a rectangular grid pattern.
Figure 5B:
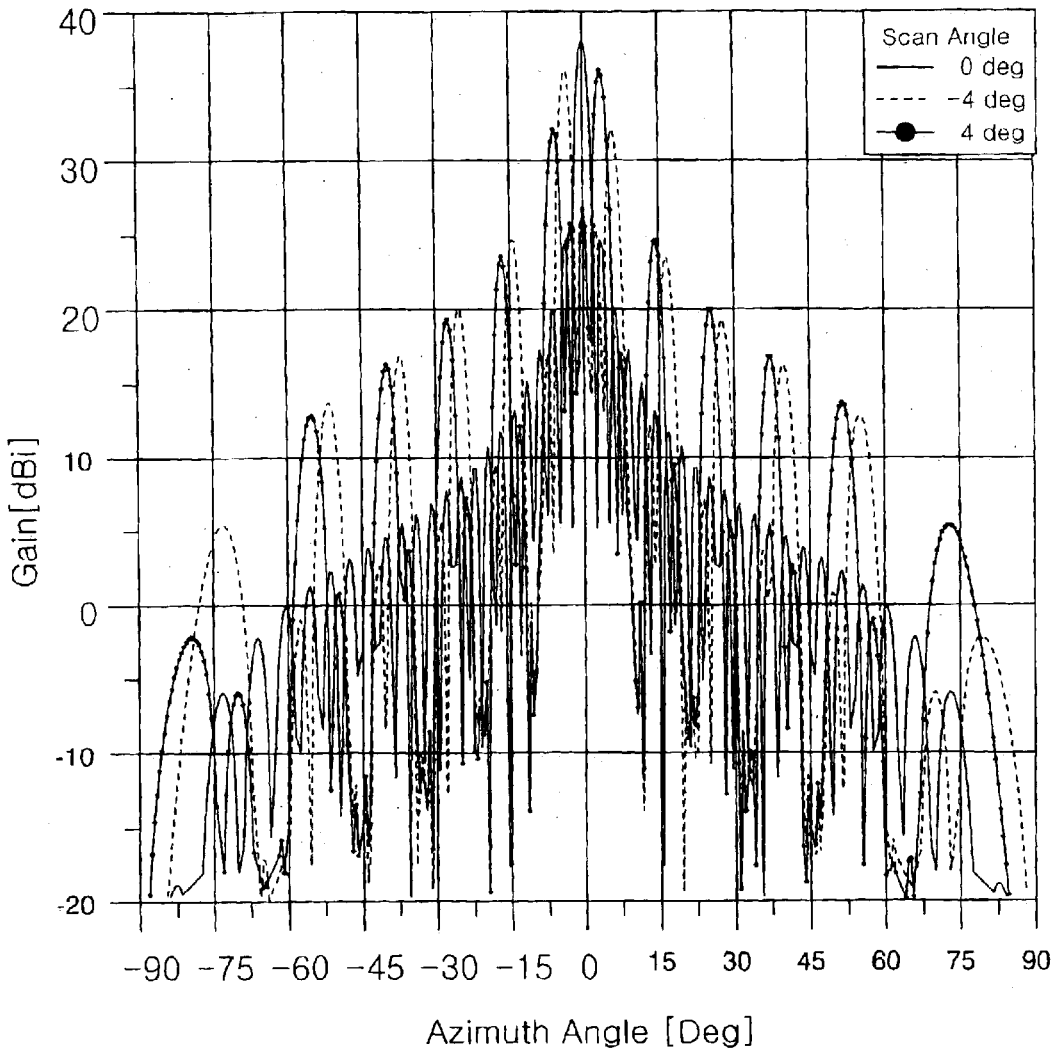
FIG. 5B (PRIOR ART)

FIGS. 4A and 4B are graphs showing radiation pattern of a microstrip patch array antenna having an array pattern for suppressing side lobes in accordance with a preferred embodiment of the present invention and FIGS. 5A and 5B are graphs for showing conventional radiation pattern of conventional microstrip path array antenna having a rectangular grid pattern.

In other words, FIG. 4A and FIG. 5A show the radiation pattern in the elevation direction and FIG. 4B and FIG. 5B shows the radiation pattern in the azimuth direction.

At first, the radiation pattern in the elevation direction according to an electric beam scan angle of the microstrip patch array antenna having array structure suppressing side lobes in FIG. 4A has identical pattern of a microstrip patch array antenna having conventional triangle grid pattern. A range of the electric beam scan angle is maximum ±35 degree of the elevation angle.

The graph in FIG. 5A is the radiation pattern in the elevation direction according to the electric beam scan angle of the microstrip patch array antenna having conventional rectangular grid pattern in case that the unit radiation element 21 and the sub array element 22 in FIG. 3 are used and the spacing between array elements are identical. The range of beam scan angle is maximum ±35 degree of the elevation angle.

As mentioned above, there is not significant difference between two patterns in FIG. 4A and FIG. 5A.

Hereinafter FIG. 4B and FIG. 5B is compared.

The radiation pattern in the azimuth direction according to electric beam scan angle of the microstrip patch array antenna in FIG. 4B has identical pattern of a microstrip patch array antenna having conventional triangle grid pattern. A range of beam scan angle is maximum ±4 degree of the azimuth angle.

The graph in FIG. 5B shows the radiation pattern in the azimuth direction according to the electric beam scan angle of the microstrip patch array antenna having conventional rectangular grid pattern in case that unit radical element 21 and sub array element 22 in FIG. 3 are used and the spacing between array elements are identical. The beam scan angle range is maximum ±4 degree of the azimuth angle.

As mentioned above, the side lobes are significantly decreased comparing to the array antenna having the conventional rectangular grid pattern.

For describing the present invention in more detail, the antenna array elements arranged followed by the conventional rectangular grid pattern is divided in half and spacing between the elements is $D_a/2$ as only an example showing one of preferred embodiment of the present invention. Therefore, such conditions of spacing and division dose not limit the present invention and the number of division and a distance of spacing may be vary according to the embodiment of the present invention.

Also, in the preferred embodiment of the present invention, "8×1" of unit sub arrays are used as only example for describing the present invention in detail. It may be predetermined and defined to any size of unit sub array for other embodiment of the present invention. Similarly, the present invention can be implemented by not only vertically, but also horizontally dividing arranged antenna array elements in rectangular planar and vertically or horizontally shifting one of dividing portion of the arranged antenna array elements within a predetermined distance.

As mentioned above, the present invention can reduce leakage of signal or prevent to receive undesired signal and to transmit signals to undesire direction by using the above mentioned array pattern instead of reducing a distance of spacing between antenna elements.

Also, the present invention can simplify processes of manufacturing an active circuit of convention triangle grid pattern has non-continuous structure by utilizing a rectangular grid pattern.

Furthermore, the present invention can be implemented by using a one radiation element as not only array element but also sub array element. As a result, manufacture process of the antenna array can be simplified.

While the present invention has been described with respect to certain preferred embodiments, it will be apparent to those skilled in the art that various changes and modifications may be made without departing from the scope of the invention as defined in the following claims.

What is claimed is:

1. A microstrip patch array antenna having a plurality of antenna array elements on two-dimensional planar having A axis and B axis, for suppressing side lobes, wherein the antenna array elements are linearly arranged in a direction of the A axis by spacing a first predetermined distance between the antenna array elements, the arranged array elements are arranged in a direction of the B axis by spacing a second predetermined distance between the antenna array elements, and a predetermined portion of the arranged array elements are shifted in the direction of the A axis by a third predetermined distance.

2. The microstrip patch array antenna as recited in claim 1, wherein A axis and B axis are perpendicular each other.

3. The microstrip patch array antenna as recited in claim 1, wherein the antenna array element is a unit radiation element.

4. The microstrip patch array antenna as recited in claim 1, wherein the antenna array element is a unit sub array element having a plurality of unit radiation elements.

5. The microstrip patch array antenna as recited in claim 1, wherein the array elements have N integer number of antenna array elements in vertical, wherein 1 to $$\frac{N}{2}$$

antenna array elements are linearly arranged in vertical direction at first and $$\frac{N}{2}+1$$

to $N^{th}$ antenna array elements are horizontally shifted in a predetermined distance based on the 1 to $$\left(\frac{N}{2}\right)^{th}$$

antenna array elements and then the $$\frac{N}{2}+1$$

to $N^{th}$ antenna array elements are linearly arranged in vertical direction.

6. The microstrip patch array antenna as recited in claim 5, wherein the predetermined distance is ½ of distance of a space between antenna array elements.

* * * * *